US005215515A

United States Patent [19]

Bershadsky

[11] Patent Number: 5,215,515

[45] Date of Patent: Jun. 1, 1993

[54] AUTOMATIC CARTON OPENING AND FEEDING APPARATUS WITH IMPROVED BREAKING AND SUPPORTING MECHANISM

[76] Inventor: Boris Bershadsky, 20982 Calle Celeste, El Toro, Calif. 92630

[21] Appl. No.: 972,222

[22] Filed: Nov. 5, 1992

[51] Int. Cl.[5] ..... B31B 5/80; B31B 1/78

[52] U.S. Cl. ..... 493/315; 493/318

[58] Field of Search ..... 493/313, 315, 317, 318, 493/319

[56] References Cited

U.S. PATENT DOCUMENTS

| | | | |
|---|---|---|---|
| 2,601,148 | 6/1952 | Williams | 493/315 |
| 2,765,715 | 10/1956 | Kerr | 493/318 |
| 2,936,861 | 5/1960 | Earp | 493/315 |
| 3,066,579 | 12/1962 | Brush | 493/318 |
| 3,242,827 | 3/1966 | Winters | 493/315 |
| 3,599,541 | 8/1971 | Allen | 493/315 |
| 4,194,442 | 3/1980 | Martelli | 493/315 |
| 4,537,587 | 8/1985 | Langen | 493/315 |
| 4,596,545 | 6/1986 | Greenwell | 493/315 |
| 4,601,691 | 7/1986 | Greenwell | 493/315 |
| 5,049,119 | 9/1991 | Bershadsky | 493/315 |
| 5,078,669 | 1/1992 | Dietrich et al. | 493/315 |
| 5,102,385 | 4/1992 | Calvert | 493/315 |

FOREIGN PATENT DOCUMENTS

| | | | |
|---|---|---|---|
| 326980 | 2/1958 | Switzerland | 493/315 |
| 738841 | 10/1955 | United Kingdom | 493/315 |

*Primary Examiner*—William E. Terrell

*Attorney, Agent, or Firm*—Thomas I. Rozsa; Dong Chen

[57] ABSTRACT

The present invention is a automatic carton opening and feeding apparatus with improved breaking and supporting mechanism. It is used in the packaging industry which automatically removes a folded carton blank from a rack or magazine of such folded carton blanks and causes the carton blank to be opened while it is being transferred to a conveyor assembly. The present invention automatic carton opening and feeding apparatus utilizes a pivoted transverse member which can swing between an open position and a closed position to break open large carton blanks more effectively. The pivoted transverse member can be activated by a simple cam follower mechanism or an air cylinder, or any suitable mechanism. The present invention apparatus further utilizes an additional supporting member mounted immediately behind and moving together with the suction cups for preventing the carton blank from being tilted, misaligned or knocked-off while being attached by the suction cups and broken open by the pivoted transverse member.

20 Claims, 2 Drawing Sheets

FIG. 1
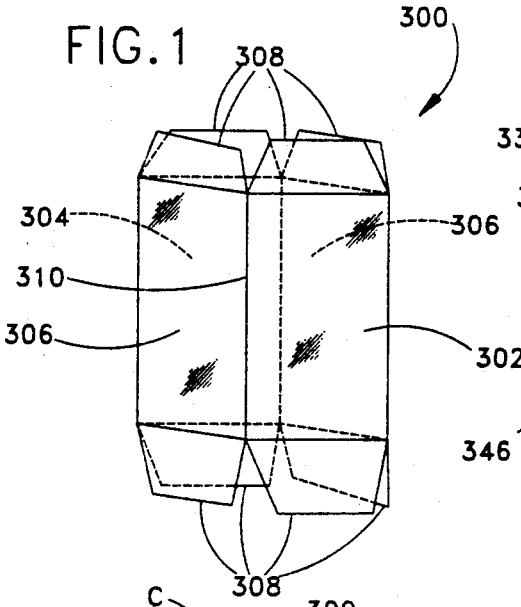
FIG. 6
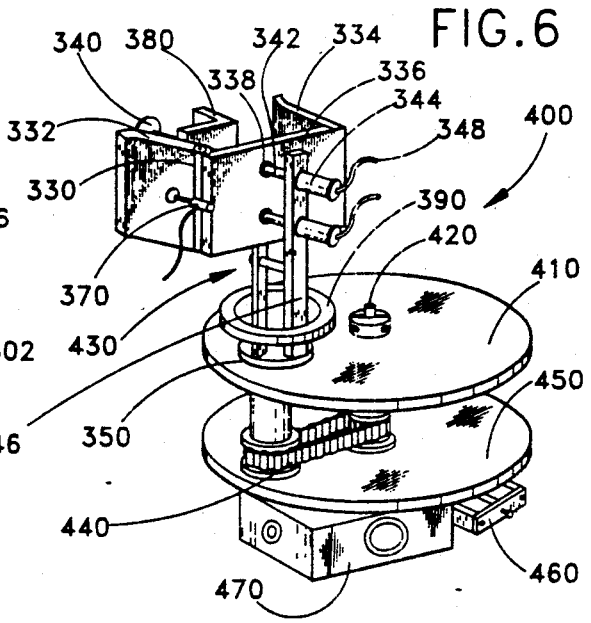
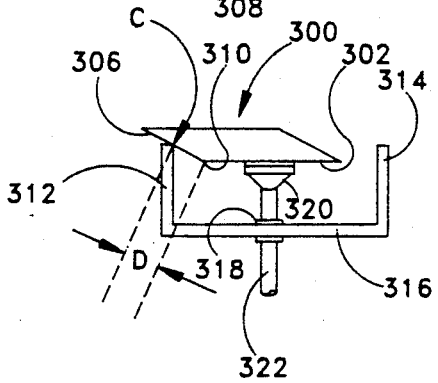
FIG. 2
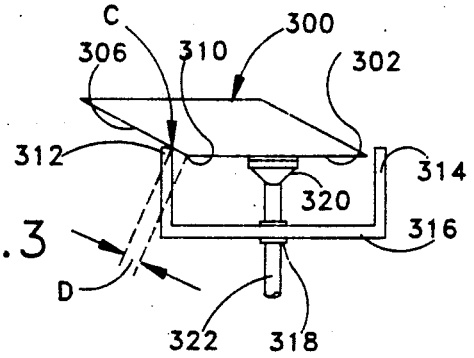
FIG. 3
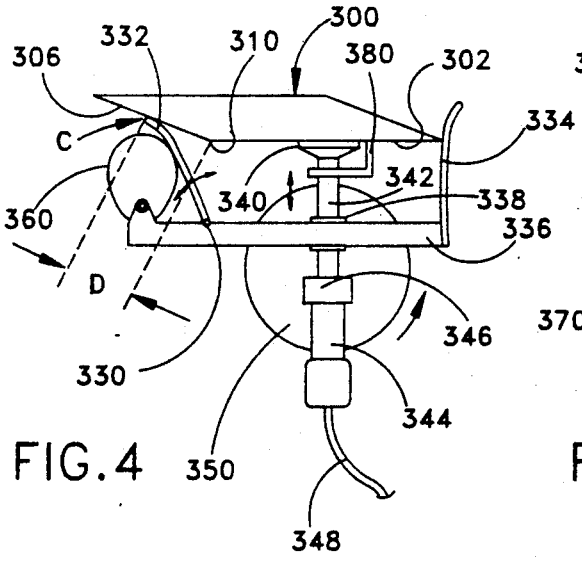
FIG. 4
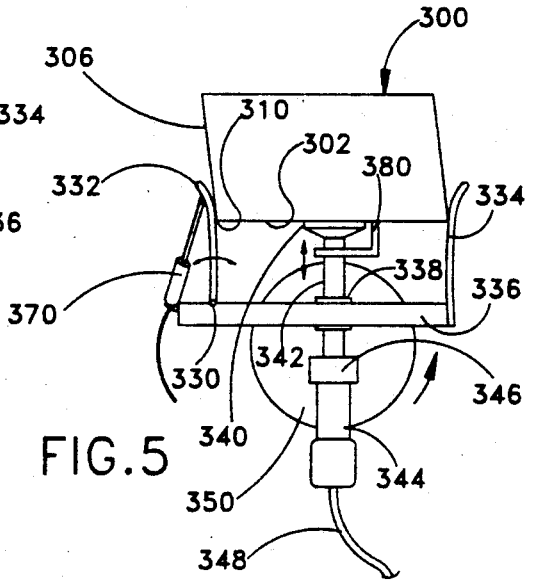
FIG. 5

AUTOMATIC CARTON OPENING AND FEEDING APPARATUS WITH IMPROVED BREAKING AND SUPPORTING MECHANISM

BACKGROUND OF THE INVENTION

1. Field of The Invention

The present invention relates to the field of automatic processing machinery used in the packaging industry. More particularly, the present invention relates to the field of automatic carton feeder apparatus for individually removing a flat carton blank from a magazine which retains a multiplicity of carton blanks in collapsed condition, partially or fully opening the carton blank, and depositing the carton blank on a conveyor assembly in the opened condition so that it is ready to receive goods as it moves along the conveyor assembly.

2. Description of The Prior Art

In general, automatic machinery which automates operations previously performed by manual labor is known in the prior art. In addition, machinery which is placed on a carousel and caused to rotate in the clockwise or counterclockwise direction while causing operating components on the machine to move from station to station and performing one or more tasks is generally known in the prior art. Furthermore, operating components such as gear and sprocket assemblies which cause the rotation of the carousel and also the rotation of one or more operating stations on the carousel, and pneumatic air valve or cam and cam follower assemblies which cause rods to move back and forth are generally known in the prior art. Finally, assemblies such as pneumatic suction cups are also well known in the prior art.

While there have been some machines known in the prior art which are designed to perform automatic carton opening and feeding operations, they either did not perform satisfactorily in actual operation, or were too complicated. The following prior art patents are related to the pertinent field.

1. U.S. Pat. No. 2,601,148 issued to Williams on Jun. 24, 1952 for "Means For Opening And Loading Carton Blanks" (hereafter "the Williams Patent").

2. U.S. Pat. No. 2,936,861 issued to Earp on May 17, 1960 for "Container Blank Feeder Mechanism" (hereafter "the Earp Patent").

3. U.S. Pat. No. 3,242,827 issued to Winters on Mar. 29, 1966 for "Apparatus And Method For Opening Cartons" (hereafter "the Winters Patent").

4. U.S. Pat. No. 3,599,541 issued to Allen on Aug. 17, 1971 for "Container Blank Variable-Speed Feeder Apparatus" (hereafter "the Allen Patent").

5. U.S. Pat. No. 4,194,442 issued to Martelli on Mar. 25, 1980 for Device For Picking Up Semi-Rigid Sheet-Like Elements From A Magazine And Transferring Them Onto A Conveyor" (hereafter "the Martelli Patent").

6. U.S. Pat. No. 4,537,587 issued to Langen on Aug. 27, 1985 for "Carton Opening Mechanism" (hereafter "the Langen Patent").

7. U.S. Pat. No. 4,596,545 issued to Greenwell on Jun. 24, 1986 for "Orbital Feeder" (hereafter "the Greenwell Patent").

The Greenwell Patent discloses an apparatus for feeding flat folded cartons from a stationary magazine to a continuously moving conveyor. A plurality of planar members with attached suction cups are rotatably mounted on a rotary carrier. A fixed cam cooperates with cam followers mounted on the planetary members to cause the planetary members to rotate on their own axis as the carrier rotates to pick up cartons from the magazine, open them and deposit them gently between transport lugs on the conveyor.

The Langen Patent discloses a carton opening mechanism for use in opening knocked-down cartons. The carton opening mechanism has a first suction face which is circumferentially spaced 120 degrees from the discharging opening of a magazine. A rotary transfer mechanism has a suction head formed with a second suction face. The carton is held between the first and second suction faces and caused to be opened while being transferred.

The Martelli Patent discloses a device for picking up carton blanks from a magazine and transferring them to a conveyor. The device has a rotating body supported by a horizontal and fixed shaft supporting a radial cam and an arm which is oscillating in a plane normal to the shaft and serving as a radial guide for a gripping member.

The Allen Patent discloses a container blank feeder apparatus for feeding containers in a collapsed form from a container magazine to a feeding station on a machine for erecting the containers for forming and filling operations. The feeder apparatus includes a base, a rotatable turret mounted on the base, and a plurality of suction cups movably mounted for rotation about the turret and for radial movements for gripping and removing the collapsed container blanks from the magazine and conveying them to the feeding station.

The Winters Patent discloses a turret-type feeder assembly for opening cartons. The feeder assembly includes a rotary bowl assembly and several pairs of suction cups. Each pair of suction cups includes an inboard suction cup for picking up a carton blank from its front panel, and an outboard suction cup for gripping the carton blank from its back panel and causing the carton blank to be opened.

The Earp Patent discloses an early container blank feeder mechanism. The feeder mechanism includes suction devices which moves radially from a turret rotating continuously at a constant angular speed to engage a container blank and remove it from a magazine. The container blank is then transferred to and deposited on a conveyor.

The Williams Patent discloses another earlier container blank opening and loading mechanism. The opening and loading mechanism includes a suction cup for holding and transporting a container blank, and a pivot claw for opening the carton when it is engaged with a fin on a rotary conveyor.

One of the difficulties encountered by the automatic carton opening and feeding machinery is how to effectively open the carton blank. Referring to FIG. 1, there is shown a typical carton blank 300. Carton blank 300 has a front panel 302, a rear panel 304, two opposite side panels 306, and several top and bottom flaps 308. The various panels of the carton blank 300 are connected along their adjacent edges. However, to facilitate opening and forming of the carton blank 300, it has been pre-folded or broken along the adjacent edges. These pre-folded or broken edges are known as "breaking score lines" or simply "scores" in the industry. For example, the scoring line between the front panel 302 and one side panel 306 is line 310. When the carton blank 300 is just removed from a magazine, it is in its essentially folded or collapsed condition. When the carton blank 300 is to be deposited to a conveyor, however, it is supposed to be in its essentially folded or collapsed condition. Therefore, to open at least partially the carton blank 300 is one of the basic tasks an automatic carton feeding machine needs to perform.

The prior art automatic carton opening and feeding assemblies have utilized several different types of approaches to achieve the objective of causing the carton blanks to open while being transferred from the magazine to the conveyor. One earlier approach is to utilize stationary angled abutment members. The Earp Patent is an example of this type of approach. Referring to FIG. 12 of the Earp Patent, a stationary angled abutment member is mounted at a fixed location along the transferring path of the carton blanks. As a carton blank is held by a suction cup at its front panel and moving along the transferring path, its one side panel engages with the stationary angled abutment member, which breaks the carton and causes it to be partially opened. The Allen Patent also utilizes a similar stationary angled abutment member to break open the carton blank (see FIG. 16 of the Allen Patent). A disadvantage of this type of approach is that the angled abutment members have to be mounted at some fixed locations adjacent to the rotary bases of the carton opening and feeding assemblies.

The Williams Patent discloses another early approach of the opening mechanism. The Williams Patent utilizes a revolving claw which is mounted at a fixed location adjacent to where the carton blank is to be deposited onto a conveyor. Referring to FIG. 3 of the Williams Patent, when the carton blank is carried by a suction cap and ready to be deposited to the conveyor, one of the spaced fins on the conveyor is engaged with one of the score lines of the carton blank, and the revolving claw is engaged with an opposite score line of the carton blank and causes the carton blank to be opened. A disadvantage of this type of approach is that it includes a complicated claw mechanism which is a separate part of the rotary work-station of the suction cup.

A different type of approach of the opening mechanism is to utilize additional opposite side suction cups. The Winters Patent teaches the use of opposite side suction cups. The carton blank is held by a front suction cup which engages its front panel and is opened by an additional suction cup which engages its back panel. The Langen Patent (FIG. 4) and the Martelli Patent (FIG. 1) also teach the use of additional suction cups engaged at different panels of the carton blank for causing the carton blank to be opened. A disadvantage of this type of approach is that the use of additional separate suction cups makes the carton opening and feeding assemblies more complicated and increases the cost of manufacture and maintenance.

The Greenwell Patent discloses still another approach of the opening mechanism. Referring to FIG. 2 of the Greenwell Patent, there is shown a small channel-shaped element mounted behind the suction cup. When the suction cup moves backward with a carton blank, the small channel-shaped element will engage two adjacent panels of the carton blank and cause it to be partially opened. A disadvantage of this type of approach is that in order to have the small channel-shaped element engaged with two adjacent panels of the carton blank, the suction cup has to engage the carton blank at a location on or about the score line between the two adjacent panels, which reduces the affixing effect of the suction cup since it works better when it engages on a flat surface.

The inventor and applicant of the instant application, Boris Bershadsky, is also the inventor and patentee of U.S. Pat. No. 5,049,119 issued on Sep. 17, 1991 (hereafter "the '119 Patent"), which disclosed an apparatus for removing a flat carton from a magazine, causing the carton to open, and placing the carton in a conveyor assembly. The '119 Patent has disclosed a novel approach of the opening mechanism. Referring to FIG. 5 of the '119 Patent, two fixed spaced apart transverse members (denoted by numerals 102 and 103) are positioned in parallel to the moving direction of the suction cup. When the carton blank comes in contact with both or at least one of the two fixed spaced apart transverse members, it is at least partially opened by the impact of the contact. Due to this distance between the two fixed spaced apart transverse members, this arrangement allows the suction cup to attach to the flat front panel of the carton blank, and makes the attachment more secure.

The automatic carton opening and feeding apparatus disclosed by the '119 Patent performs well in most of the situations. Nevertheless it has been experienced that for large sized carton blanks, sometimes the opening mechanism is not as effective as for medium and small sized carton blanks. Large carton blanks sometimes cannot be effectively opened or become tilted or even get knocked off when they come into contact with the fixed spaced apart transverse members mounted behind the suction cup. Therefore, it is highly desirable to improve the automatic carton opening and feeding apparatus so that the system performs satisfactorily with not only small and medium sized carton blanks, but also large sized carton blanks.

SUMMARY OF THE INVENTION

The present invention is an automatic carton opening and feeding apparatus with improved breaking and supporting mechanism.

It is known that the automatic carton opening and feeding apparatus can utilize radially movable suction cups to detachably affix and transfer carton blanks. To cause the carton blank to be at least partially opened, fixed spaced apart transverse members can be mounted behind suction cups for causing the carton blank to open upon contact. However, it has been experienced with large sized carton blanks that the opening mechanism does not function as effectively as with small or medium sized carton blanks. Sometimes when larger carton blanks come into contact with the fixed spaced apart transverse members, the carton blanks are not effectively opened, or become tilted, or even get knocked-off from the suction cups.

It has been discovered, according to the present invention, that the aforementioned troubles with large carton blanks are caused by the inflexible characteristics of the fixed spaced apart transverse members. Referring to FIG. 2, there is illustrated the relationship between the carton blank 300 and the two fixed spaced apart transverse members 312 and 314. The carton blank 300 is attached by a suction cup 320 mounted on a suction cup post 322. The two fixed spaced apart members 312 and 314 are fixedly attached to a supporting post 316. The suction cup post 322 is slidably engaged with supporting post 316 through a bearing 318. The two fixed spaced apart members 312 and 314 are therefore parallel to the suction cup post 322.

When the suction cup post 322 withdraws, the suction cup 320 moves the carton black 300 towards the two fixed spaced apart transverse members 312 and 314. Since the suction cup 320 attaches to the front panel 302 of the carton blank, at least one of the side panels 306 will contact at least one of the two fixed transverse members 312 and 314 respectively. For example, as shown in FIG. 2, right side panel 306 of the carton blank 300 is brought into contact with the fixed transverse member 312. The impact of this contact will cause the collapsed carton blank 300 to be at least partially open.

The impact of the contact is proportional to the torque distance "D" between the score line 310 of the carton blank 300 and the contacting point "C" of the fixed member 312 and the side panel 306 of the carton blank 300. As shown in FIG. 2, when the carton blank 300 is small or medium sized, this torque distance "D" is relatively large. Accordingly the contact impact is relatively large and more effective to fold the side panel 306 over towards the front panel 302, which causes the carton blank 300 to open.

However, as shown in FIG. 3, when the carton blank 300 is large sized, the contacting point "C" of the fixed member 312 and the side panel 306 of the carton blank 300 is very close to the score line 310 of the carton blank 300. This results in a relatively small torque distance "D". Accordingly the contact impact is relatively small and less effective to force side panel 306 over towards the front panel 302 for causing the carton blank 300 to be opened. Instead, this smaller torque distance "D" makes it more likely to cause the large carton blank 300 to be tilted or even get knocked-off. This is why the fixed configuration of the spaced apart transverse members has trouble with large carton blanks.

It has therefore been discovered, according to the present invention, that if in an automatic carton opening and feeding apparatus which utilizes suction cups for attaching carton blanks and transverse members mounted behind the suction cup for causing carton blanks to be opened upon impact, one of the transverse members is pivoted and can swing between an open position and a closed position, then the pivoted transverse member can be initially left at its open position when a carton blank is attached by the suction cup on its front panel and moved towards the transverse members, and subsequently activated to swing to its closed position to push one of the side panels of the carton blank for effectively causing the carton blank to be opened.

It has further been discovered, according to the present invention, that in the automatic carton opening and feeding apparatus which utilizes suction cups for attaching a carton blank and a pivoted transverse member for pushing the side panel of the carton blank, if the pivoted transverse member is controlled by a cam follower mechanism which is connected to the main rotatory mechanism of each operating station of the carousel, then the pivoted member can be automatically activated by the cam follower mechanism in compliance with the movement of the suction cups of the operating station.

It has also been discovered, according to the present invention, that in the automatic carton opening and feeding apparatus which utilizes suction cups for attaching a carton blank and a pivoted transverse member for pushing the side panel of the carton blank, if the pivoted transverse member is controlled by an air cylinder mechanism which is connected to the main vacuum source of each operating station of the carousel, then the pivoted member can be automatically activated by the air cylinder mechanism in compliance with the movement of the suction cups of the operating station.

It has been additionally discovered, according to the present invention, that in the automatic carton opening and feeding apparatus which utilizes suction cups for attaching a carton blank and a pivoted transverse member for pushing the side panel of the carton blank, if an additional supporting member is mounted immediately behind the suction cups and moves together with the suction cups, then the supporting member can be maintained in contact at all time with the carton blank while it is attached by the suction cup, to prevent the carton blank from being tilted or misaligned.

It is therefore an object of the present invention to provide an automatic carton opening and feeding apparatus which utilizes suction cups for attaching carton blanks and at least one pivoted transverse member mounted behind the suction cup for causing carton blanks to be effectively opened, wherein the pivoted member can swing between an open position and a closed position, so that the pivoted transverse member can be initially left at its open position when a carton blank is attached by the suction cup on its front panel and moved towards the transverse members, and subsequently activated to swing to its closed position to push one of the side panels of the carton blank for effectively causing the carton blank to be opened.

It is an additional object of the present invention to provide an automatic carton opening and feeding apparatus which utilizes suction cups for attaching a carton blank and a pivoted transverse member for pushing the side panel of the carton blank, wherein the pivoted transverse member is controlled by a cam follower mechanism which is connected to the main rotatory mechanism of each operating station of the carousel, so that the pivoted member can be automatically activated by the cam follower mechanism in compliance with the movement of the suction cups of the operating station.

It is also an object of the present invention to provide an automatic carton opening and feeding apparatus which utilizes suction cups for attaching a carton blank and a pivoted transverse member for pushing the side panel of the carton blank, wherein the pivoted transverse member is controlled by an air cylinder mechanism which is connected to the main vacuum source of each operating station of the carousel, so that the pivoted member can be automatically activated by the air cylinder mechanism in compliance with the movement of the suction cups of the operating station.

It is a further object of the present invention to provide an automatic carton opening and feeding apparatus which utilizes suction cups for attaching a carton blank, a pivoted transverse member for pushing the side panel of the carton blank and an additional supporting member mounted immediately behind and moving together with the suction cups, such that the supporting member can maintain in contact at all times with the carton blank while it is attached by the suction cup, to prevent the carton blank from being tilted or misaligned.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of a carton blank.

FIG. 2 is a diagrammatic view of an arrangement of a suction cup and fixed transverse members, showing that a small or medium sized carton blank attached by the suction cup and brought into contact with one fixed transverse member can be effectively opened upon impact, because the torque distance "D" of the impact is relatively large.

FIG. 3 is a diagrammatic view showing that a large sized carton blank may not be effectively opened by the same arrangement of suction cup and fixed transverse members shown in FIG. 2, because the torque distance "D" of the impact is substantially reduced due to the large size of the carton blank.

FIG. 4 is a diagrammatic view showing the improved opening mechanism of the present invention apparatus which utilizes a pivoted transverse member for effectively opening large sized carton blanks, where the pivoted transverse member is operated by a cam follower mechanism.

FIG. 5 is a diagrammatic view showing the improved opening mechanism of the present invention carton apparatus utilizing the pivoted transverse member, which is operated by a cam follower mechanism.

FIG. 6 is a partial perspective view of the present invention automatic carton opening and feeding apparatus.

DESCRIPTION OF THE PREFERRED EMBODIMENT

Figure 7:
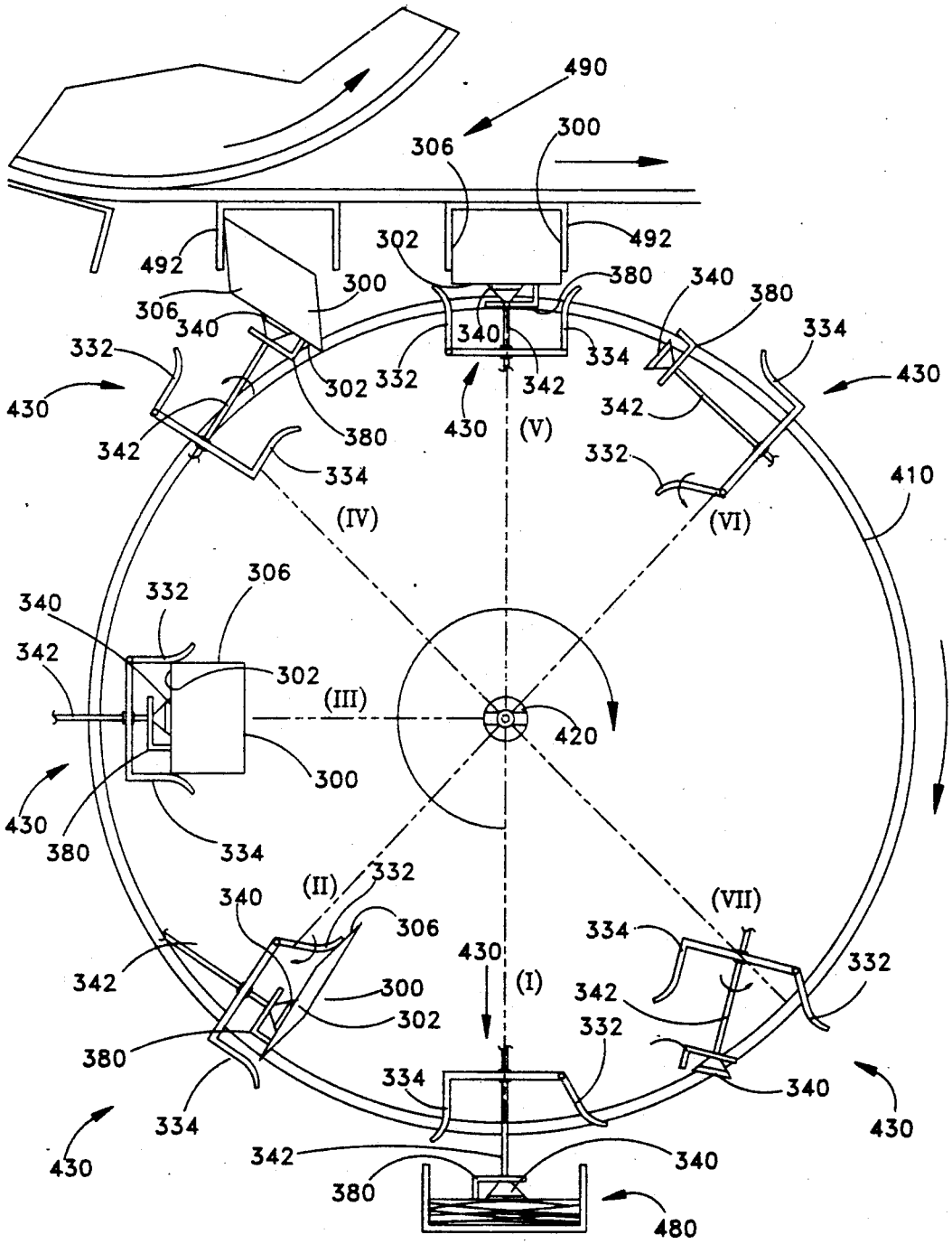
FIG. 7 is a diagrammatic view illustrating the operating process of the present invention automatic carton opening and feeding apparatus.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an improvement over the automatic carton opening and feeding apparatus disclosed in the '119 Patent. The '119 Patent has taught in substantial detail about the mechanical arrangement of the apparatus. The overall mechanical arrangement of the present invention apparatus is similar to that disclosed in the '119 Patent, with certain modifications or variations which will be specified later.

The principal improvement of the present invention automatic carton opening and feeding apparatus is illustrated in FIGS. 4 and 5. Referring to FIG. 4, instead of having two fixed transverse members, the present invention opening mechanism utilizes a hinge means 330 for mounting a pivoted transverse member 332, opposite to a still fixed transverse member 334, onto a widened supporting post 336. A suction cup 340 is mounted on a suction cup post 342, which again is slidably engaged with the supporting post 336 through a bearing means 338.

The suction cup post 342 is engaged in a telescoping relationship with a suction cup post air cylinder 344, which is in turn mounted to a station post 346. The suction cup post air cylinder 344 is connected to a vacuum source by a cable 348. The supporting post 336 and station post 346 are engaged with a same station cam 350, so they are rotated together by the station cam 350 while always maintaining a parallel relationship.

The pivoted transverse member 332 can swing between an inclined open position as shown in FIG. 4, and a closed position, which is parallel to the suction cup post 342 and the fixed transverse member 334, as shown in FIG. 5. Furthermore, the pivoted transverse member 332 may be operated through a cam mechanism 360 as shown in FIG. 4, or an air cylinder mechanism 370 as shown in FIG. 5, or any other suitable mechanisms such as a crank and rocker mechanism. The cam mechanism 360 may be coupled with the station cam 350 so that the pivoted transverse member 332 can be automatically activated by the cam mechanism 360 in compliance with the movement of the suction cup 340. The alternative air cylinder mechanism 370 may be connected to the same vacuum source as the suction cup post air cylinder 344.

Initially the pivoted transverse member 332 is located at its open position, as the carton blank 300 moves towards and is brought into contact with it. Since the pivoted transverse member 332 is wide open, its contacting point "C" on the side panel 306 of the carton blank 300 is far away from the respective score line 310 of the carton blank 300. This ensures that the torque distance "D" of the impact is relatively large. Subsequently the pivoted transverse member 332 swings towards the fixed transverse member 334, and pushes the side panel 306 of the carton blank 300. Once the pivoted transverse member 332 reaches its closed position, the carton blank 300 is substantially opened.

To prevent the carton blank from being tilted, an additional supporting member 380 is provided. The supporting member 380 is mounted to the suction cup post 342, so that it moves together with the suction cup 340. The additional supporting member 380 may have a L-shaped configuration, so that although it is mounted on the suction cup post 342 between the suction cup 340 and the supporting post 336, it can still engage the front panel 302 of the carton blank 300. This is to ensure that the supporting member 380 can be maintained in contact at all times with the carton blank 300 while the carton blank 300 is attached by the suction cup 340, to prevent the carton blank 300 from being tilted or misaligned. Of course the additional supporting member 380 may be arranged so that it can engages with the other side panel 306 of the carton blank 300.

Referring to FIG. 6, there is shown a partial perspective view of one of the preferred embodiments of the present invention automatic carton opening and feeding apparatus 400. The automatic carton opening and feeding apparatus 400 is a carousel which includes a rotary base 410, which rotates about a central shaft 420. Although only one operating station 430 is shown in FIG. 6, a suitable number of such operating stations can be installed on the rotary base 410. A rotary and cam mechanism 440 may be installed between the rotary base 410 and a fixed base 450. The rotary and cam mechanism 440 functions to drive the rotary base 410 to rotate about the central shaft 420 in one direction, and drive the operating station 430 to rotate in the opposite direction. For example, in FIG. 6 the rotary base 410 is rotating in a clockwise direction, while the opening station 430 is rotating in the opposite counter-clockwise direction.

The automatic carton opening and feeding apparatus 400 may further include a main vacuum valve box 460 and a bottom base 470, which may function as the housing of a main rotary and gear mechanism, and also function as the base for mounting the whole apparatus to a large scale automated machinery. Various detailed mechanical arrangements of the automatic carton opening and feeding carousel 400 have been disclosed by the '119 Patent. It should be noted that the embodiments of the present invention are not limited to the particular embodiments disclosed in the '119 Patent or in this application.

The operating process of the present invention automatic carton opening and feeding carousel 400 is illustrated in FIG. 7. The carousel 400 is positioned between a carton blank magazine 480 and a conveyor 490. The rotary base 410 rotates in the clockwise direction, and each operating station mounted thereupon such as operating station 430 rotates in the counterclockwise direction. The magazine 480 comprises a multiplicity of folded cartons blanks. At area "T", when operating station 430 is coming into alignment with the magazine 480, the pivoted transverse member 332 is in its wide open position, and the suction cup 340 reaches the outermost carton blank 300 in the magazine 480 and removes it therefrom. The carton blank 300 is attached by suction cup 340 while supported by supporting member 380, and transferred away.

From area "II" to area "III", the carton blank 300 is moved towards and brought into contact with the pivoted transverse member 332 and the fixed transverse member 334. The pivoted transverse member 332 is activated to swing towards the fixed transverse member 334, and pushes side panel 306 of the carton blank 300. While the pivoted transverse member 332 is pushing the side panel 306 of the carton blank 300, the supporting member 380 is engaged upon the front panel 302 of the carton blank 300 and prevents it from being tilted or misaligned. When the pivoted transverse member 332 reaches its closed position, the carton blank 300 is substantially opened.

At area "IV" the operating station 430 comes into alignment with the conveyor 490. As the rotary base 420 continues to rotate, the opened carton blank 300 is brought into contact with a respective carton blank receiving and retaining means 492 on the conveyor 490. This further ensures that the carton blank 300 is maintained in the opened status right before it is being deposited to the conveyor 490. At area "V" the opened carton blank 300 is pushed into and deposited within the receiving and retaining means 492 of the conveyor 490.

After the carton blank 300 is deposited, the operating station 430 moves from area "VI" to area "VII". While the operating station 430 completes its working circle, the pivoted transverse member 332 is activated to swing away from the fixed transverse member 334 towards its wide opened position, making it ready to transfer the next carton blank.

The present invention has many advantageous features, including: (a) it provides an automatic carton opening and feeding apparatus utilizing a pivoted transverse member which can swing between an open position and a closed position to break open large carton blanks more effectively; (b) the pivoted transverse member can be activated by a simple cam mechanism or an air cylinder, or any suitable mechanism; (c) it further provides an additional supporting member mounted immediately behind and moving together with the suction cups for preventing the carton blank from being tilted, misaligned or knocked off; (d) all mechanical components are installed on a carousel, so that the carousel can be transported, installed and used as a unitary unit, without extra components mounted at other fixed locations; (d) no extra suction cup for opening the carton blanks, nor separate claw type mechanism, is required, therefore the mechanical complexity of the whole apparatus is greatly reduced; and (e) the suction cup can engages the flat panel of the carton blanks, which is much more secure than having the suction cup attached to the corner score line of the carton blanks.

Defined in detail, the present invention is an apparatus for automatically removing a folded carton from a magazine which contains a multiplicity of stacked flat folded cartons, opening the carton during transferring, and placing the opened carton in a carton receiving and retaining means of a conveyor assembly, the apparatus comprising: (a) a carousel base located between said magazine and said conveyor assembly and rotatable in a given direction; (b) at least one operating station having a station post and a supporting post and mounted on said carousel base, and being rotatable in a direction opposite to said given rotating direction of said carousel base; (c) a suction attaching and retaining means movably supported on said operating station and connected to a vacuum suction source; (d) means for causing said suction attaching and retaining means to move radially inward toward and outward from said station post; (e) at least one fixed transverse member supported on and extending from said supporting post, and positioned adjacent and spaced to permit said suction attaching and retaining means to move radially inward toward and outward from said station post; (f) at least one movable transverse member pivoted on said supporting post at a location opposite to said at least one fixed transverse member, and being able to swing between an open position which is inclined away from said suction attaching and retaining means and a closed position which is adjacent and spaced to permit said suction attaching and retaining means to move radially inward toward and outward from said station post; (g) means for swinging said pivoted transverse member between said open position and said closed position; (h) at least one additional supporting member mounted on and moving radially together with said suction attaching and retaining means; and (i) means for causing said carousel base to rotate such that said at least one operating station comes into alignment with said magazine and said conveyor assembly sequentially; (j) whereby (1) when said at least one operating station is aligned with said magazine, said pivoted transverse member is in said open position, and said suction attaching and retaining means is caused to move radialy outward from said station post and come in contact with a flat front panel of an outmost folded carton in said magazine, and said vacuum suction source causes the folded carton to be attached to and removed away from said magazine by said suction attaching and retaining means; (2) when said at least one operation station is moving toward said conveyor assembly, said suction attaching and retaining means is caused to move radially inwardly toward said station post, and said pivoted transverse member is caused to swing toward said closed position and come in contact with an adjacent flat side panel of said folded carton for causing said carton to be substantially opened, while said at least one additional supporting member is continuously engaged with said carton for preventing said carton from being tilted or misaligned; (3) when said at least one operating station is aligned with said conveyor assembly, said suction attaching and retaining means is once again caused to move radially outward from said station post and said substantially opened carton is caused to engage said carton receiving and retaining means of said conveyor assembly and become fully opened and said suction source thereupon releases said fully opened carton into said carton receiving and retaining means of said conveyor assembly; (4) when said at least one operation station is moving back toward said magazine, said suction attaching and retaining means is caused once again to move radially inward toward said station post, while said pivoted transverse member is caused to swing to said open position, so that said at least one operating station is ready for attaching and transferring another one of said multiplicity of stacked folded cartons in said magazine.

Defined broadly, the present invention is an apparatus for automatic carton opening and feeding operation, the apparatus comprising: (a) a rotatable carousel base located between a magazine containing a multiplicity of stacked folded cartons and a conveyor assembly having carton receiving and retaining means; (b) at least one operating station having a supporting post and rotatably mounted on said carousel base; (c) a suction attaching and retaining means movably supported on said operating station and connected to a vacuum suction source; (d) means for causing said suction attaching and retaining means to move radially inward toward and outward from an axis of said at least one operation station; (e) at least one movable transverse member pivoted on said supporting post and being able to swing between an open position which is inclined away from said suction attaching and retaining means and a closed position which is adjacent and spaced to permit said suction attaching and retaining means to move radially; (f) means for swinging said pivoted transverse member between said open position and said closed position; and (g) means for causing said carousel base to rotate such that said at least one operating station comes into alignment with said magazine and said conveyor assembly sequentially; (h) whereby (1) when said at least one operating station is aligned with said magazine, said pivoted transverse member is in said open position, and said suction attaching and retaining means is caused to move outwardly and come in contact with a panel of an outmost folded carton in said magazine, and said vacuum suction source causes the folded carton to be attached to and removed away from said magazine by said suction attaching and retaining means; (2) when said at least one operation station is moving toward said conveyor assembly, said suction attaching and retaining means is caused to move inwardly, and said pivoted transverse member is caused to swing toward said closed position and come in contact with another panel of said bolded carton for causing said carton to be substantially opened; (3) when said at least one operating station is aligned with said conveyor assembly, said suction attaching and retaining means is once again caused to move outwardly to release said opened carton into said carton receiving and retaining means of said conveyor assembly; (4) when said at least one operation station is moving back toward said magazine, said suction attaching and retaining means is caused once again to move inwardly, while said pivoted transverse member is caused to swing to said open position, so that said at least one operating station is ready for attaching and transferring another one of said multiplicity of stacked folded cartons in said magazine.

Defined alternatively, the present invention is a method for automatic carton opening and feeding operation, the method comprising the steps of: (a) locating a carousel with a rotatable base between a magazine containing a multiplicity of stacked folded cartons and a conveyor assembly having carton receiving and retaining means; (b) rotatably mounting at least one operating station with a supporting post on said rotatable base; (c) movably supporting a suction attaching and retaining means on said operating station and connecting the suction attaching and retaining means to a vacuum suction source; (e) causing said suction attaching and retaining means to move radially inward toward and outward from an axis of said at least one operation station; (e) installing at least one pivoted transverse member on said supporting post such that it can swing between an open position which is inclined away from said suction attaching and retaining means and a closed position which is adjacent and spaced to permit said suction attaching and retaining means to move radially; (g) causing said carousel base to rotate such that said at least one operating station comes into alignment with said magazine and said conveyor assembly sequentially; (h) when said at least one operating station is aligned with said magazine, causing said suction attaching and retaining means to move outwardly to attached a panel of an outmost folded carton in said magazine and remove the carton away from said magazine, while maintaining said pivoted transverse member in said open position; (i) when said at least one operation station is moving toward said conveyor assembly, causing said suction attaching and retaining means to move inwardly, while causing said pivoted transverse member to swing toward said closed position and come in contact with another panel of said folded carton to open said carton substantially; (j) when said at least one operating station is aligned with said conveyor assembly, causing said suction attaching and retaining means to move outwardly to release said opened carton into said carton receiving and retaining means of said conveyor assembly; and (k) when said at least one operation station is moving back toward said magazine, causing said suction attaching and retaining means to move inwardly, while causing said pivoted transverse member to swing to said open position, so that said at least one operating station is ready for attaching and transferring another one of said multiplicity of stacked folded cartons in said magazine.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for automatically removing a folded carton from a magazine which contains a multiplicity of stacked flat folded cartons, opening the carton during transferring, and placing the opened carton in a carton receiving and retaining means of a conveyor assembly, the apparatus comprising:

a. a carousel base located between said magazine and said conveyor assembly and rotatable in a given direction;

b. at least one operating station having a station post and a supporting post and mounted on said carousel base, and arranged to rotate in a direction opposite to said given rotating direction of said carousel base;

c. a suction attaching and retaining means movably supported on said operating station and connected to a vacuum suction source;

d. means for causing said suction attaching and retaining means to move radially inward toward and outward from said station post;

e. at least one fixed transverse member supported on and extending from said supporting post, and positioned adjacent and spaced to permit said suction attaching and retaining means to move radially inward toward and outward from said station post;

f. at least one movable transverse member pivoted on said supporting post at a location opposite to said at least one fixed transverse member, and being able to swing between an open position which is inclined away from said suction attaching and retaining means and a closed position which is adjacent and spaced to permit said suction attaching and retaining means to move radially inward toward and outward from said station post;

g. means for swinging said pivoted transverse member between said open position and said closed position;

h. at least one additional supporting member mounted on and moving radially together with said suction attaching and retaining means; and i. means for causing said carousel base to rotate such that said at least one operating station comes into alignment with said magazine and said conveyor assembly sequentially;

j. whereby 1) when said at least one operating station is aligned with said magazine, said pivoted transverse member is in said open position, and said suction attaching and retaining means is caused to move radially outward from said station post and come in contact with a flat front panel of an outmost folded carton in said magazine, and said vacuum suction source causes the folded carton to be attached to and removed away from said magazine by said suction attaching and retaining means;

2) when said at least one operation station is moving toward said conveyor assembly, said suction attaching and retaining means is caused to move radially inwardly toward said station post, and said pivoted transverse member is caused to swing toward said closed position and come in contact with an adjacent flat side panel of said folded carton for causing said carton to be substantially opened, while said at least one additional supporting member is continuously engaged with said carton for preventing said carton from being tilted or misaligned;

3) when said at least one operating station is aligned with said conveyor assembly, said suction attaching and retaining means is once again caused to move radially outward from said station post and said substantially opened carton is caused to engage said carton receiving and retaining means of said conveyor assembly and become fully opened and said suction source thereupon releases said fully opened carton into said carton receiving and retaining means of said conveyor assembly;

4) when said at least one operation station is moving back toward said magazine, said suction attaching and retaining means is caused once again to move radially inward toward said station post, while said pivoted transverse member is caused to swing to said open position, so that said at least one operating station is ready for attaching and transferring another one of said multiplicity of stacked folded cartons in said magazine.

2. The invention as defined in claim 1 wherein said suction attaching and retaining means includes at least one suction cup and a respective suction post which is slidably supported by said supporting post through bearing means.

3. The invention as defined in claim 1 wherein said station post and said supporting post of said at least one operating station are engaged with a same station cam, such that they are rotated together by the station cam while always maintaining a parallel relationship.

4. The invention as defined in claim 1 wherein said means for swinging said pivoted transverse member between said open position and said closed position includes a cam mechanism which functions in accordance with said radially inward and outward movement of said suction attaching and retaining means.

5. The invention as defined in claim 1 wherein said means for swinging said pivoted transverse member between said open position and said closed position includes an air cylinder mechanism which is also connected to said vacuum suction source and functions in accordance with said radially inward and outward movement of said suction attaching and retaining means.

6. The invention as defined in claim 1 wherein said means for swinging said pivoted transverse member between said open position and said closed position includes a crank and rocker mechanism which is also connected to said vacuum suction source and functions in accordance with said radially inward and outward movement of said suction attaching and retaining means.

7. The invention as defined in claim 2 wherein said additional supporting member is mounted to and supported by said suction post.

8. An apparatus for automatic carton opening and feeding operation, the apparatus comprising:

a. rotatable carousel base located between a magazine containing a multiplicity of stacked folded cartons and a conveyor assembly having carton receiving and retaining means;

b. at least one operating station having a supporting post and mounted on and arranged to rotate relative said carousel base;

c. a suction attaching and retaining means movably supported on said operating station and connected to a vacuum suction source;

d. means for causing said suction attaching and retaining means to move radially inward toward and outward from the rotational axis of said at least one operation station;

e. at least one movable transverse member pivoted on said supporting post and being able to swing between an open position which is inclined away from said suction attaching and retaining means and a closed position which is adjacent and spaced to permit said suction attaching and retaining means to move radially;

f. means for swinging said pivoted transverse member between said open position and said closed position; and g. means for causing said carousel base to rotate such that said at least one operating station comes into alignment with said magazine and said conveyor assembly sequentially;

h. whereby 1) when said at least one operating station is aligned with said magazine, said pivoted transverse member is in said open position, and said suction attaching and retaining means is caused to move outwardly and come in contact with a panel of an outmost folded carton in said magazine, and said vacuum suction source causes the folded carton to be attached to and removed away from said magazine by said suction attaching and retaining means;

2) when said at least one operation station is moving toward said conveyor assembly, said suction attaching and retaining means is caused to move inwardly, and said pivoted transverse member is caused to swing toward said closed position and come in contact with another panel of said folded carton for causing said carton to be substantially opened;

3) when said at least one operating station is aligned with said conveyor assembly, said suction attaching and retaining means is once again caused to move outwardly to release said opened carton into said carton receiving and retaining means of said conveyor assembly;

4) when said at least one operation station is moving back toward said magazine, said suction attaching and retaining means is caused once again to move inwardly, while said pivoted transverse member is caused to swing to said open position, so that said at least one operating station is ready for attaching and transferring another one of said multiplicity of stacked folded cartons in said magazine.

9. The invention as defined in claim 8 wherein said suction attaching and retaining means includes at least one suction cup and a respective suction post which is slidably supported by said supporting post through bearing means.

10. The invention as defined in claim 8 wherein said means for swinging said pivoted transverse member between said open position and said closed position includes a cam mechanism which functions in accordance with said radially inward and outward movement of said suction attaching and retaining means.

11. The invention as defined in claim 8 wherein said means for swinging said pivoted transverse member between said open position and said closed position includes an air cylinder mechanism which is also connected to said vacuum suction source and functions in accordance with said radially inward and outward movement of said suction attaching and retaining means.

12. The invention as defined in claim 8 wherein said means for swinging said pivoted transverse member between said open position and said closed position includes a crank and rocker mechanism which is also connected to said vacuum suction source and functions in accordance with said radially inward and outward movement of said suction attaching and retaining means.

13. The invention as defined in claim 8 further comprising at least one fixed transverse member supported on and extending from said supporting post at a location opposite to said at least one fixed transverse member, and positioned adjacent and spaced to permit said suction attaching and retaining means to move radially.

14. The invention as defined in claim 8 further comprising at least one additional supporting member mounted on and moving radially together with said suction attaching and retaining means, such that while said carton is attached by said suction attaching and retaining means, the at least one additional supporting member is continuously engaged with said carton for preventing said carton from being tilted or misaligned.

15. A method for automatic carton opening and feeding operation, the method comprising the steps of:

a. locating a carousel with a rotatable base between a magazine containing a multiplicity of stacked folded cartons and a conveyor assembly having carton receiving and retaining means;

b. rotatably mounting at least one operating station with a supporting post on said rotatable base to rotate about an axis relative said carousel;

c. movably supporting a suction attaching and retaining means on said operating station and connecting the suction attaching and retaining means to a vacuum suction source;

d. causing said suction attaching and retaining means to move radially inward toward and outward from the rotational axis of said at least one operation station;

e. installing at least one pivoted transverse member on said supporting post such that it can swing between an open position which is inclined away from said suction attaching and retaining means and a closed position which is adjacent and spaced to permit said suction attaching and retaining means to move radially;

g. causing said carousel base to rotate such that said at least one operating station comes into alignment with said magazine and said conveyor assembly sequentially;

h. when said at least one operating station is aligned with said magazine, causing said suction attaching and retaining means to move outwardly to attached a panel of an outmost folded carton in said magazine and remove the carton away from said magazine, while maintaining said pivoted transverse member in said open position;

i. when said at least one operation station is moving toward said conveyor assembly, causing said suction attaching and retaining means to move inwardly, while causing said pivoted transverse member to swing toward said closed position and come in contact with another panel of said folded carton to open said carton substantially;

j. when said at least one operating station is aligned with said conveyor assembly, causing said suction attaching and retaining means to move outwardly to release said opened carton into said carton receiving and retaining means of said conveyor assembly; and k. when said at least one operation station is moving back toward said magazine, causing said suction attaching and retaining means to move inwardly, while causing said pivoted transverse member to swing to said open position, so that said at least one operating station is ready for attaching and transferring another one of said multiplicity of stacked folded cartons in said magazine.

16. The invention as defined in claim 15 wherein said pivoted transverse member is caused to swing by a cam mechanism which functions in accordance with said radially inward and outward movement of said suction attaching and retaining mean.

17. The invention as defined in claim 15 wherein said pivoted transverse member is caused to swing by an air cylinder mechanism which is also connected to said vacuum suction source and functions in accordance with said radially inward and outward movement of said suction attaching and retaining means.

18. The invention as defined in claim 15 wherein said pivoted transverse member is caused to swing by a crank and rocker mechanism which is also connected to said vacuum suction source and functions in accordance with said radially inward and outward movement of said suction attaching and retaining means.

19. The invention as defined in claim 15 further comprising the step of providing at least one fixed transverse member on and extended from said supporting post, and positioned adjacent and spaced to permit said suction attaching and retaining means to move radially.

20. The invention as defined in claim 15 further comprising the step of providing at least one additional supporting member on and movable radially together with said suction attaching and retaining means, such that while said carton is attached by said suction attaching and retaining means, the at least one additional supporting member is continuously engaged with said carton for preventing said carton from being tilted or misaligned.

* * * * *